United States Patent [19]

Skinner et al.

[11] 4,438,747

[45] Mar. 27, 1984

[54] FUEL INJECTION PUMPING APPARATUS

[75] Inventors: Robert T. J. Skinner, High Wycombe; Brian W. Tumber, Greenford, both of England

[73] Assignee: Lucas Industries Limited, Birmingham, England

[21] Appl. No.: 379,147

[22] Filed: May 17, 1982

[30] Foreign Application Priority Data

May 28, 1981 [GB] United Kingdom ..... 8116307

[51] Int. Cl.[3] ..... F02D 17/00

[52] U.S. Cl. ..... 123/450; 123/449; 123/459; 417/462

[58] Field of Search ..... 123/450, 449, 458, 459, 123/387; 417/462

[56] References Cited

U.S. PATENT DOCUMENTS

| | | | |
|---|---|---|---|
| 3,101,079 | 8/1963 | Evans | 123/450 |
| 3,485,225 | 12/1969 | Bailey et al. | 123/387 |
| 3,861,833 | 1/1975 | Salzgeber et al. | 417/254 |
| 4,019,835 | 4/1977 | Skinner | 417/462 |
| 4,292,012 | 9/1981 | Brotherston | 417/462 |
| 4,362,141 | 12/1982 | Mowbray | 123/450 |
| 4,367,714 | 1/1983 | Di Domenico et al. | 123/449 |
| 4,393,826 | 7/1983 | Tumber | 123/387 |
| 4,397,615 | 8/1983 | Mowbray | 123/450 |
| 4,406,264 | 9/1983 | Mowbray | 123/387 |

FOREIGN PATENT DOCUMENTS

| | | | |
|---|---|---|---|
| 210211 | 12/1959 | Austria | 123/450 |

*Primary Examiner*—Ira S. Lazarus
*Assistant Examiner*—Magdalen Moy

[57] ABSTRACT

A fuel injection pumping apparatus of the rotary distributor type has a distributor member which is also axially movable to determine the allowed outward movement of the pumping plungers and hence the amount of fuel supplied to the associated engine. The extent of outward movement is determined by inclined stop surfaces which co-operate with complementary surfaces on shoes associated with the plungers. In order to minimize axial movement of the distributor member when the shoes engage the stop surfaces a chamber to which liquid is supplied to vary the axial setting of the distributor member, is locked off from fluid supply and drain passages, by a servo valve 41 when the correct position of the distributor member is obtained. A hydraulic lock is thus created in the chamber.

11 Claims, 4 Drawing Figures

FUEL INJECTION PUMPING APPARATUS

This invention relates to fuel injection pumping apparatus for supplying fuel to internal combustion engines and of the kind comprising a rotary distributor member mounted in a body, plungers carried in a bore in the distributor member, a cam ring having cam lobes operating as the distributor member rotates to effect inward movement of the plungers thereby to cause delivery of fuel by the apparatus, a low pressure pump for supplying fuel to said bore, said distributor member being axially movable to determine the amount of fuel supplied at each delivery stroke of the plungers, and fluid pressure operable means for varying the axial setting of the distributor member.

An example of such an apparatus is shown in British published Specification No. 2037365A. Two examples are shown in the afore mentioned specification of hydraulic arrangements for varying the axial setting of the distributor member. In one arrangement a piston acts on one end of the distributor member and a control pressure is applied to the piston to urge the distributor member against the action of a spring in a direction to increase the amount of fuel supplied by the apparatus. The apparatus incorporates inclined stops to limit the outward movement of the plungers and the axial component of the reaction force generated when the stops are brought into operation has to be resisted by the spring. In order to withstand the reaction force the spring must have substantial strength and therefore the piston must be large in order to exert sufficient force to compress the spring. One advantage of this arrangement is that in the event of failure of the fluid pressure the distributor member will move to the minimum or zero fuel position.

In another arrangement the distributor member is biased by a spring to a position of maximum fuel and the control pressure is applied to an end face of the distributor member. The reaction force mentioned above still occurs and causes discrepancies in the setting of the distributor member by displacing fuel from a chamber which is in part defined by the end face of the distributor member.

The object of the present invention is to provide an apparatus of the kind specified in a simple and convenient form.

According to the invention in an apparatus of the kind specified said fluid pressure operable means comprises a resiliently loaded servo valve responsive to a control pressure, a variable volume chamber defined at least in part by a surface movable with the distributor member, said servo valve acting to control the admission of fluid to and the escape of fluid from said chamber, and resilient means for opposing the force exerted on said surface by the fluid pressure in said chamber.

In the accompanying drawings

Figure 1:
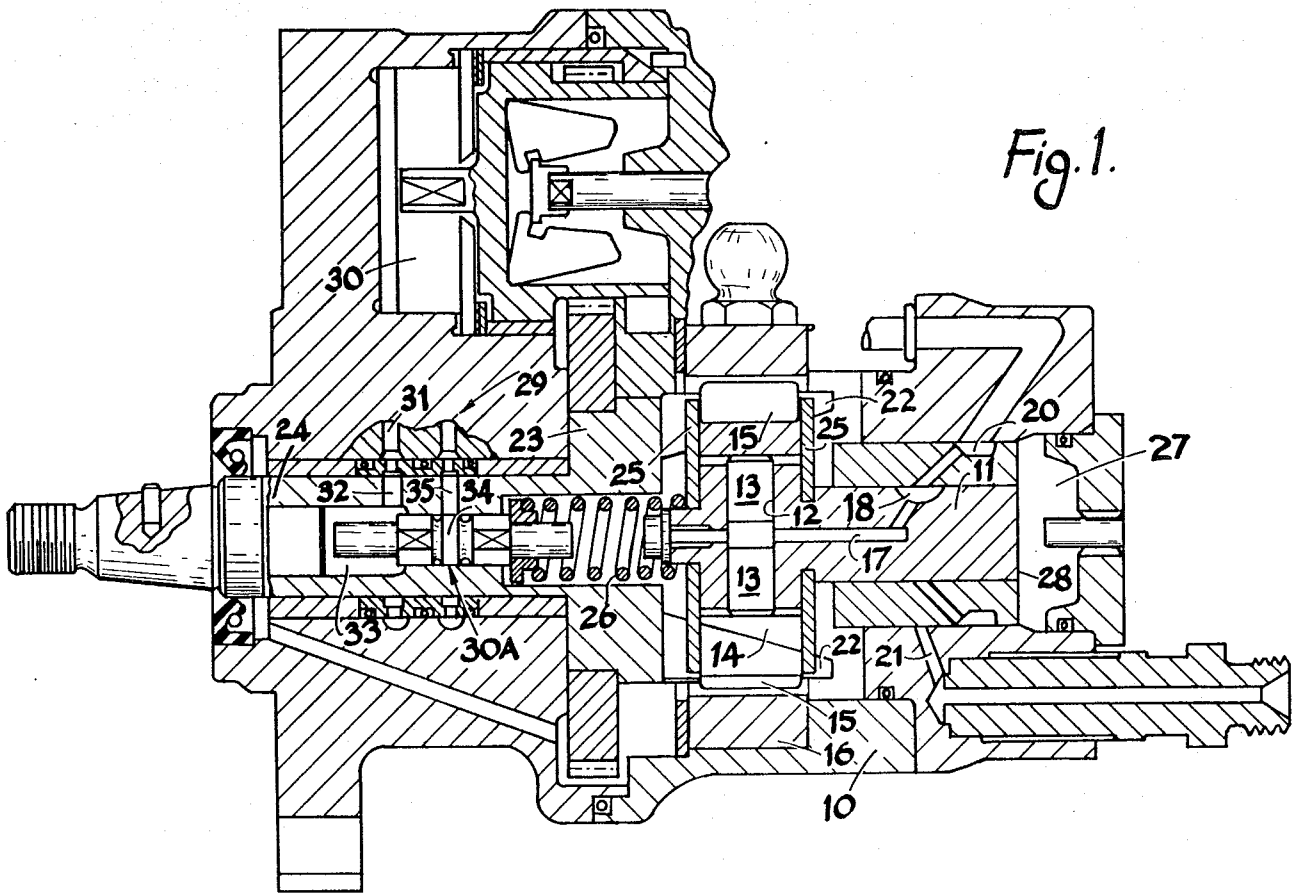
FIG. 1 is a part sectional side elevation of part of a pumping apparatus in accordance with the invention.

Referring to FIG. 1 of the drawings the apparatus comprises a body 10 in which is journalled a rotary cylindrical distributor member 11 which is provided with a transverse bore 12 accommodating a pair of pumping plungers 13. At their outer ends, the plungers engage shoes 14 respectively mounting rollers 15 which are engageable with cam lobes formed on the internal peripheral surface of an annular cam ring 16 which can be moved in known manner, about the axis of rotation of the distributor member 11. Defined between the plungers is a pumping chamber which communicates with a longitudinal bore 17 formed in the distributor member and which extends to a longitudinal slot 18 on the periphery of the distributor member. The slot 18 can communicate in turn with a plurality of inlet passages 19 which connect with a circumferential groove 20 formed in the body 10 and connected to a source of fuel. Alternately disposed relative to the passages 19 are a plurality of outlet ports part of one of which is seen at 21 and the groove 18 is brought into register with an outlet port 21 during the time the plungers 13 are moved inwardly by the cam lobes.

The extent of outward movement of the plungers 13 is controlled by inclined surfaces 22 which can co-operate with complementary surfaces formed on the shoes 14. The surfaces 22 are defined by the internal surface of a cup-shaped member 23 which is integral with the drive shaft 24 the latter extending to the exterior of the apparatus and being connected in use to a drive member of the associated engine. The wall of the cup-shaped member defines slots in which are located the shoes 14 and the distributor member itself is driven by plates 25 which have portions located in the aforesaid slots.

The distributor member is axially movable whereby the extent of outward movement of the plungers 13 can be varied and in the example shown in FIG. 1, a spring 26 is provided to bias the distributor member towards the right and in a direction to allow additional outward movement of the plungers and thereby an increase in the amount of fuel supplied by the apparatus.

A chamber 27 is defined at the end of the distributor member which therefore has a surface 28 exposed to the chamber. Liquid under pressure can be admitted to the chamber.27 to move the distributor member against the action of the spring 26. The liquid under pressure which is supplied to the chamber 27 is in fact fuel and the admission of fuel to the chamber 27 is controlled by a servo valve which is generally indicated at 29. Fuel is supplied by a low pressure pump generally indicated at 30 driven by gearing or a flexible belt, from the drive shaft. Various control means not shown are provided to derive a control pressure which is applied to the servo valve member 30A by way of a passage 31 in the body and a passage 32 formed in the drive shaft. The passage 32 communicates with a chamber 33 so that the pressure can act upon one end of the servo valve. Movement of the servo valve is opposed by the action of the spring 26. Moreover, the servo valve has a land 34 which controls a port 35 opening into the chamber, the port 35 being in constant communication with the chamber 27. On one side of the land 34 is fuel at the control pressure whilst on the other side of the land is fuel at drain pressure and the arrangement is such that if the control pressure is increased, the servo valve member 30A will move against the action of the spring 26 to allow fuel to flow into the chamber 27 thereby moving the distributor member towards the left as seen in FIG. 1. This movement will have the effect of increasing the force exerted by the spring 26 upon the servo valve member and the port 35 wil be re-closed once an equilibrium position has been established. With the port 35 closed fuel cannot enter or leave the chamber 27 so that the axial component of the reaction forces which are set up when the shoes engage the surfaces 22 cannot effect movement of the distributor member. In the event that the control pressure falls then the servo valve member 30A will move in the opposite direction to uncover the port 35 to the drain and fuel can flow out of the chamber 27. As fuel is displaced from the chamber the force exerted by the spring 26 is reduced and a new equilibrium position is established with the land 34 covering the port 35.

The arrangement described with reference to FIG. 1 therefore provides for positive location of the distributor member during operation of the apparatus but it does have the disadvantage that in the event of failure of the control pressure, the servo valve will permit fuel to escape from the chamber 27 so that the distributor member will move under the action of the spring 26 to increase the amount of fuel supplied to the engine. Moreover, it is very difficult to adjust the force exerted by the spring 26.

Figure 2:
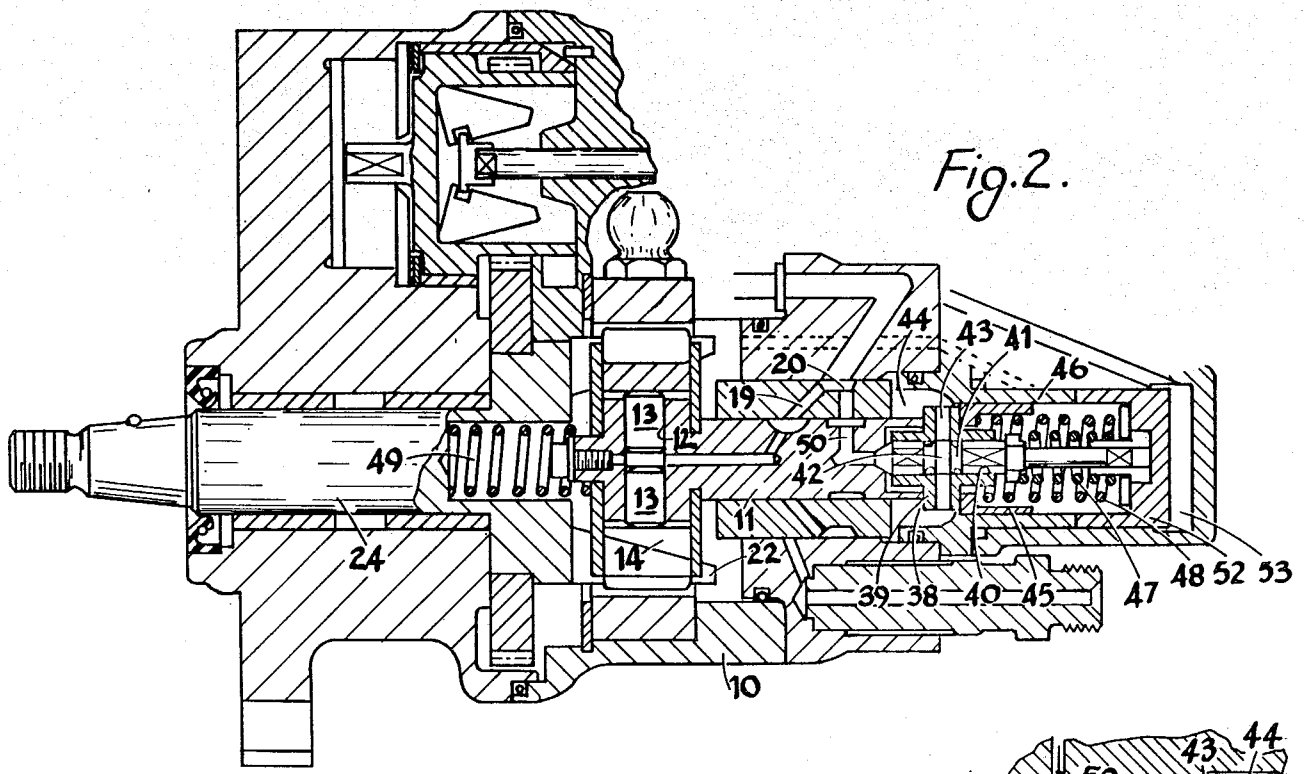
FIG. 2 is a view similar to FIG. 1 showing a modification.

The disadvantage mentioned above is overcome by the arrangement shown in FIG. 2 and wherever possible, the same reference numerals have been utilized. The servo valve which is generally indicated at 38, is located at the opposite end of the distributor member as compared with the arrangement shown in FIG. 1. The servo valve comprises a housing 39 which is in screw thread engagement with the distributor member 11 and it defines a bore 40 in which the servo valve member 41 can slide. The servo valve member is retained against angular movement and is provided with a land 42 which controls ports 43 communicating with the chamber 44. The housing 39 is provided with a flange which bears against an annular member 45 slidably mounted in a bore formed in a housing 46 which is secured to the body 10 of the apparatus. The flange and the member 45 provide a seal and the interior of the housing 46 is connected to a drain. The servo valve member is biased in a direction towards the distributor member by a spring 47 and the member 45 is biased in the same direction by a spring 48. In addition, a spring 49 is positioned between the drive shaft 24 and the distributor member but the spring 49 is weaker than the spring 48 so that in the absence of fluid pressure, the distributor member will be biased towards the minimum fuel position that is to say towards the left as seen in FIG. 2. Fuel under pressure is applied to the servo valve member by way of a passage 50 formed in the distributor member and which connects with the circumferential groove 20. The pressure of fuel supplied to the groove 20 is controlled so that it forms the control pressure, the pressure being adequate to ensure filling of the bore containing the plungers.

In operation, if the control pressure is increased, the servo valve member will be moved towards the right against the action of the spring 47 and the ports 43 will be uncovered to the left hand side of the land 42 so tha fuel at the control pressure can enter the chamber 45. The pressure of fuel in the chamber 44 acts upon a surface which is in part defined by the left hand surface of the flange on the housing 39 and in part by the end face of the member 45 which is exposed to the chamber 38 and the distributor member therefore moves towards the right against the action of the spring 48. During such movement the ports 43 are closed and an equilibrium position is established. Since the chamber 44 is now effectively closed it can resist movement of the distributor member by the axial components of the reaction force which is created when the shoes engage the surfaces 22. If the control pressure is decreased then the land 42 exposes the ports 43 to the drain pressure and fuel can flow out of the chamber 44 so that under the action of the spring 48, the distributor member moves towards the left to establish a new equilibrium position. The purpose of the spring 49 is to provide a sealing force between the engaging surfaces of the member 45 and the flange on the housing 39. The arrangement described therefore with reference to FIG. 2 has the advantage that if the control pressure falls to a low value then whilst fuel will continue to be supplied to the bore 12, the spring 48 will move the distributor member to the minimum or zero fuel position.

Figure 3:
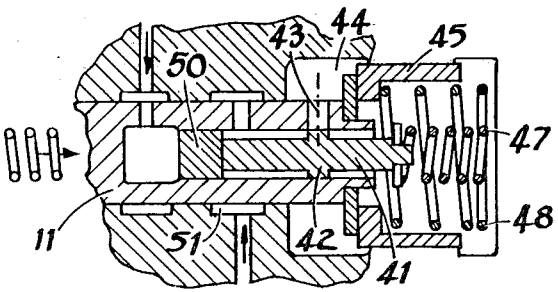
FIG. 3 is a view showing an alternative arrangement of part of the apparatus of FIG. 2.

In the arrangement of FIG. 2 the fuel which is supplied to the chamber 44 is the control pressure which is also supplied to the bore 12. It may be advantageous to derive the fuel which is supplied to the chamber 44 directly from the outlet of the pump 30 and this arrangement is seen in FIG. 3. In FIG. 3 the housing 39 has been omitted and the servo valve member 41 is slidable within a bore in the distributor member. In addition, the servo valve is provided with an additional land 50 against which the control pressure acts in opposition to the spring 47. The annular space defined between the lands 42 and 50 is connected by way of drillings in the distributor member and a circumferential groove 51 in the body part, with the outlet of the supply pump.

In FIG. 2 and as described above, in the absence of the control pressure the distributor member is moved to the minimum or zero fuel position. For starting purposes it is necessary to allow the distributor member to move to the maximum or even excess fuel position to facilitate the starting of the engine and it is desirable that this should take place immediately upon trying to start the engine. In order to achieve this object the springs 47 and 48 as their ends remote from the member 45 and the servo valve member 41 respectively, engage a piston 52 which constitutes the abutment for those springs. The position of the piston 52 during normal operation, is as shown in FIG. 2 and it is maintained in this position by fuel under pressure which is supplied to a chamber 53. The supply of fuel to this chamber is controlled by a valve and the fuel is allowed to escape from the chamber 53 for the purpose of starting the associated engine. When the piston 52 is in the retracted position, the force exerted by the spring 48 is less than that which is exerted by the spring 49 so that the latter spring is able to move the distributor member to the maximum fuel position. The control of the pressure of fuel in the chamber 53 is effected by way of a valve which is itself responsive to the outlet pressure of the low pressure pump. Until this pressure reaches a predetermined value, the valve remains in the off position so that maximum or excess fuel is supplied to the engine. When the output pressure reaches a predetermined value the valve moves to the open position and fuel from the outlet of the low pressure pump is supplied to the chamber 53 to move the piston 52 to the position in which it is shown in FIG. 2.

The control pressure may be generated in any convenient manner for example using an electromagnetic valve the current flow to which is controlled by a control system which receives signals indicative of the engine speed and other operating parameters and also a signal indicative of the axial position of the distributor member, this signal providing an indication of the amount of fuel which is being supplied to the associated engine. It may also be generated by a mechanical arrangement and an example of this is seen in FIG. 4.

Figure 4:
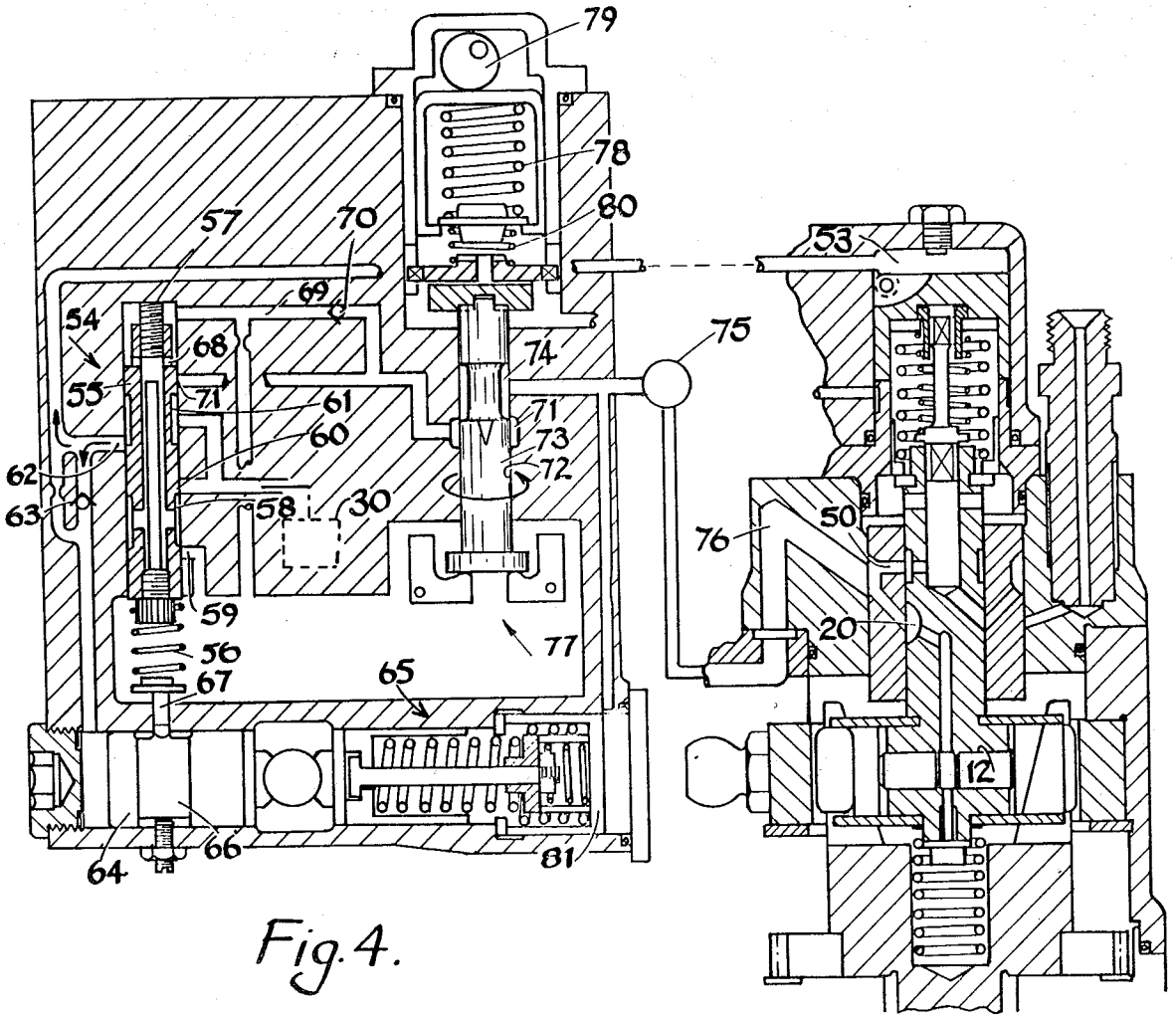
FIG. 4 is a diagrammatic view of an apparatus showing a mechanical arrangement for generating a control pressure.

Referring to FIG. 4, the low pressure supply pump is shown at 30 and it incorporates a relief valve not shown, which controls its output pressure so that it varies with speed. The outlet of the pump 30 communicates with the chamber 53 by way of a valve which is generally indicated at 54. This valve is a latch valve and comprises a valve member 55 slidable within a cylinder. The valve member is loaded towards one end of the cylinder by a coiled compression spring 56. The other end of the cylinder mounts a plug 57 which is slidable within a bore formed in the valve member, the bore being closed at its end adjacent the spring. Moreover, the end portion of the valve member adjacent the other end of the cylinder is of reduced diameter.

The bore in the valve member communicates with a first circumferential groove 58 which communicates with ports 59, 60 formed in the wall of the cylinder. The port 59 communicates with a drain and the port 60 with the outlet of the supply pump 30. A second circumferential groove 61 is formed in the valve member and this groove is in constant communication with the outlet of the supply pump 30. A port 62 in the wall of the cylinder is positioned so that it can open to the groove 61 when the valve member has been moved against the action of the spring 56. The port 62 communicates with the chamber 53 and also by way of a non-return valve 63 having a restriction in parallel therewith, with a cylinder which houses a piston 64. The piston 64 is coupled to the cam ring 16 and can move the cam ring angularly against the action of a spring pack 65. This piston defines a cam profile 66 against which bears a spring abutment 67 which locates the spring 56.

The bore in the valve member at its end adjacent the plug can communicate with the adjacent end of the bore by way of a pair of ports 68 and from this end of the cylinder there extends a passage 69 in which is located a non-return valve 70. A port 71 in the cylinder communicates with the passage 69 downstream of the valve 70. The valve serves to provide a controlled fuel pressure and this is achieved by means of the groove 58 and which during running, effects restricted communication between the ports 59 and 60. The pressure in the bore acts on the valve member against the action of the spring 56 and if this pressure tends to increase the valve member will move to restrict the communication of the groove 58 with the port 60 thereby reducing the pressure of fuel.

Fuel is conveyed through the passage 69 to an annular groove 71 formed in a bore 72 in which is mounted a rotary valve member 73. The valve member is provided with a circumferential groove 74 which by way of an on/off valve 75, communicates with a conduit 76. The grooves 71 and 74 define a variable orifice. For the purpose of starting the engine the valve member 55 moves to a position so that the groove 61 communicates with the port 71 the valve in this situation not having any control over the pressure and also preventing the supply of fuel under pressure to the space 53.

The axial setting of the valve member 73 is determined by a centrifugal weight mechanism generally indicated at 77 and which acts on the valve member 73 in opposition to the force exerted by a governor spring 78. The force exerted by the spring 78 is adjustable by means of a cam 79 which is connected to the throttle control of the vehicle with which the apparatus is associated. As is usual, an idling spring 80 is provided for controlling the idling speed of the engine and if desired, the spring 78 may either be a pre-stressed spring (as shown), in which case a two speed governor action is obtained or it may be a free spring in which case an all speed governor action is obtained. As the force exerted by the spring 78 is increased, the groove 74 will move into register with the groove 71 and the pressure in the conduit 76 will increase so that the distributor member will be moved to permit an increased supply of fuel to the associated engine. As the engine speed increases, an increased force will be exerted by the governor weights and the valve member 73 will be moved to reduce the control pressure in the conduit 76. The pressure in the conduit 76 is always sufficient to ensure that the bore 12 is filled with fuel.

The pressure of fuel in the conduit 76 is also applied to a piston 81 which serves as an abutment for the spring pack 65. The piston 64 is subject to the output pressure of the pump 30 under the control of the valve 54 and in addition, the cam profile 66 acts to vary the force exerted by the spring 56 on the valve member 55. The effect of this is that the regulated pressure which is provided by the valve 72 is modified in accordance with the output pressure of the pump 30 and since this is arranged to vary in accordance with the speed, the pressure in the conduit 76 also varies in accordance with the speed to provide what is known in the art as "torque control".

We claim:

1. A fuel injection pumping apparatus for supplying fuel to internal combustion engines comprising a rotary distributor member mounted in a body, plungers carried in a bore in the distributor member, a cam ring having cam lobes operating as the distributor member rotates to effect inward movement of the plungers thereby to cause delivery of fuel by the apparatus, a low pressure pump for supplying fuel to said bore, said distributor member being axially movable to determine the amount of fuel supplied at each delivery stroke of the plungers, fluid pressure operable means for varying the axial setting of the distributor member, said fluid pressure operable means comprising a resiliently loaded servo valve responsive to a control pressure, a variable volume chamber defined at least in part by a surface movable with the distributor member, said servo valve acting to control the admission of fluid to and the escape of fluid from said chamber and resilient means for opposing the force exerted on said surface by the fluid pressure in said chamber.

2. An apparatus according to claim 1, including a drive shaft which is axially fixed within the body, means coupling the drive shaft to the distributor member, said servo valve being slidable within a further chamber formed in the drive shaft, passage means through which fluid at the control pressure can be supplied to said further chamber to act upon said servo valve, said resilient means comprising a coiled compression spring acting between the servo valve and the distributor member.

3. A fuel injection pumping apparatus for supplying fuel to internal combustion engines comprising a rotary distributor member mounted in a body, plungers carried in a bore in the distributor member, a cam ring having cam lobes operating as the distributor member rotates to effect inward movement of the plungers, thereby to cause delivery of fuel by the apparatus, a low pressure pump for supplying fuel to said bore, said distributor member being axially movable to determine the amount of fuel supplied at each delivery stroke of the plungers, fluid pressure operable means for varying the axial setting of the distributor member, said fluid pressure operable means comprising a resiliently load servo valve slidable in a second bore defined in a part carried by the distributor member, said servo valve being responsive to a control pressure, passage means through which fluid under pressure can be supplied to the inner end of said second bore to act upon said servo valve, a variable volume chamber defined at least in part by a surface movable with the distributor member, said servo valve acting to control the admission of fluid to and the escape of fluid from said chamber, a first spring acting upon said servo valve to provide the resilient loading thereof, and a second spring for opposing the force exerted on said surface by the fluid pressure in said chamber, said second spring engaging an annular part slidable within a housing secured to the body, said annular part cooperating with said part carried by the distributor member to provide a seal.

4. An apparatus according to claim 3, including a third spring acting upon the distributor member, said third spring acting in a direction to oppose the action of said second spring, the force exerted by the third spring being less than the force exerted by the second spring.

5. An apparatus according to claim 4, including means for generating said control pressure, said means deriving said control pressure from the output pressure of the low pressure pump.

6. An apparatus according to claim 5, in which fuel at said control pressure is supplied to the bore containing said plungers.

7. An apparatus according to claim 4, in which the means deriving said control pressure includes, a variable orifice, speed responsive means operable with increasing speed to reduce the size of said orifice, resilient means acting in opposition to said speed responsive means and valve means positioned upstream of said variable orifice, for controlling the fuel pressure upstream thereof.

8. An apparatus according to claim 7, in which said resilient means comprises a main governor spring and an idling spring connected in series, an adjustable abutment for said springs, said springs acting upon a valve member slidable in a bore, the valve member and the bore defining said variable orifice.

9. An apparatus according to claim 7, in which said valve means comprises a valve member slidable within a cylinder, resilient means biasing the valve member towards one end of said cylinder, passage means communicating with said one end of the cylinder and said variable orifice and co-operating ports and groove means in the cylinder and valve member for controlling the pressure in said one end of the cylinder.

10. An apparatus according to claim 9, including means responsive to the output pressure of the supply pump for controlling the force exerted upon said valve member by said resilient means.

11. An apparatus according to claim 10, including an abutment for said first and second springs, said abutment comprising a fluid pressure operable piston, the application of fluid pressure to said piston being controlled by said valve means.

* * * * *